United States Patent [19]

Yoshiyama et al.

[11] Patent Number: 4,772,919

[45] Date of Patent: Sep. 20, 1988

[54] ELECTROPHOTOGRAPHIC COPYING MACHINE

[75] Inventors: Tsugihito Yoshiyama; Masataka Oda, both of Toyohashi, Japan

[73] Assignee: Minolta Camera Kabushiki Kaisha, Osaka, Japan

[21] Appl. No.: 903,777

[22] Filed: Sep. 5, 1986

[30] Foreign Application Priority Data

Sep. 13, 1985 [JP] Japan ..... 60-204068

[51] Int. Cl.[4] ..... G03G 15/02; G03G 15/04; G03G 15/06

[52] U.S. Cl. ..... 355/14 E; 355/14 CH; 355/14 D

[58] Field of Search ..... 355/3 R, 3 CH, 3 TR, 355/14 CH, 14 E, 14 D

[56] References Cited

U.S. PATENT DOCUMENTS

| | | | |
|---|---|---|---|
| 3,950,680 | 4/1976 | Michaels et al. | 355/14 CH X |
| 4,021,111 | 5/1977 | Kuroishi et al. | 355/14 CH X |
| 4,136,942 | 1/1979 | Nakahata et al. | 355/14 CH X |
| 4,256,401 | 3/1981 | Fujimura et al. | 355/14 E |
| 4,339,783 | 7/1982 | Kinashi et al. | 355/14 CH X |
| 4,508,446 | 4/1985 | Imai | 355/14 E X |
| 4,636,063 | 1/1987 | Takai et al. | 355/14 E X |

*Primary Examiner*—Fred L. Braun

*Attorney, Agent, or Firm*—Burns, Doane, Swecker & Mathis

[57] ABSTRACT

An electrophotographic copying machine adapted to provide a copied image for preparing a master plate for a thermal type stencil printing machine as well as a copied image for other, ordinary use. The copying machine includes an image forming device including a photosensitive member defining a photoconductive layer on a surface thereof, a charging device for charging the surface of the photosensitive member, an exposure device for illuminating an original image and forming on the photosensitive member an electrostatic latent image corresponding to the original image, and a developing device for causing a charged toner to electrostatically and selectively adhere to the electrostatic latent image on the photosensitive member. The copying machine further includes a transfer device for transferring the charged toner from the photosensitive member to copying paper, and an image density dropping device for selectively controlling the image forming device to cause a sharp drop in an image density on the copying paper with respect to a density of the original.

22 Claims, 3 Drawing Sheets

ELECTROPHOTOGRAPHIC COPYING MACHINE

BACKGROUND OF THE INVENTION (1) Field of the Invention

The present invention relates to an electrophotographic copying machine comprising a photosensitive member for carrying a latent image of an original illuminated by a light source, and a developing device for developing the latent image on the photosensitive member into a visible image.

(2) Description of the Prior Art

The electrophotographic copying machine noted above is also known as the PPC (plain paper copying) machine and is in wide use for recording clear images on ordinary recording paper speedily. One application of this electrophotographic copying machine is found in the production of an original for use in preparing a master plate for thermal stencil printing which is one type of stencil printing.

The master plate for a thermal type stencil printing machine is prepared by using the original and a stencil paper comprising a thermoplastic resin film affixed to a meshed support member. The stencil paper is pressed on the original such that the film is placed in contact with an image-carrying face of the original, and then the combination is illuminated at the stencil paper side by a light full of infrared rays. At this time the image portion of the original absorbs the energy of the light and generates heat, which heats the thermoplastic resin film in pressure contact with the original. The film then becomes fused and shrinks, forming holes in a portion of the film opposed to the image portion of the original, thereby producing the master plate.

When preparing the master plate for the thermal type stencil printing machine by using a colored starting document as distinct from the abovementioned "original" produced by the electrophotographic copying machine, this starting document is copied by the electrophotographic copying machine for use as the original for preparing the master plate. In other words, the colored document cannot be used as it is as the original for preparing the master plate because of its variation in hue which results in differing rates of light absorption and hence uneven heat generation. Therefore, the colored document is copied by the electrophotographic copy machine to eliminate its colors (the resulting copy being hereinafter referred to as PPC original) for preparation of the master plate.

Incidentally, it is difficult to make out copied letters and pictures when the density of a copied image is too low. In order to avoid this, the electrophotographic copying machine normally is set such that a solid pattern density as measured with a densitometer is at least 1.1, preferably not below 1.25. Furthermore, there is a known electrophotographic copying machine capable of varying the density of the copied image within the above-noted range in order to effect reproduction according to the density of the original to be copied.

However, the above known machine has the following problem and there is room for improvement.

With the electrophotographic copying machine, copies are produced by causing thermally fusible toner particles to electrostatically and selectively adhere to a latent image on the photosensitive member and thermally fusing these toner particles transferred onto recording paper to fix the particles thereto. However, the resulting PPC original also carries toner particles not sufficiently fixed to the image portion. Such toner particles tend to be the greater in amount the higher the density of the copied image is.

Consequently, when such a PPC original is used to prepare the master plate, the toner particles not sufficiently fixed to the original are melted by the energy of illumination which results in plugging of holes formed in the thermoplastic resin film. Prints produced by using this master plate, therefore, have a blurred image portion as a result of insufficient passage of ink through the holes of the film.

In order to eliminate such an inconvenience, the density of the PPC original may be reduced. However, with the known electrophotographic copying machine, the density remains in a range suited for normal copying even if the machine is set for the lower limit of the density of a recorded image wherein the low density suited for preparation of the master plate for the thermal type stencil printing machine cannot be realized.

SUMMARY OF THE INVENTION

Having regard to the above-noted state of the art, the object of the present invention is to provide an electrophotographic copying machine capable of producing a copied image having the density suited for preparation of the master plate for the thermal type stencil printing machine, and readily switchable between such a function and a normal copying function.

It has been found through repeated tests that, even if a copy having too low a density for normal recording purposes because of difficulties in making out letters and pictures, such a copy is capable of sufficient energy absorption for forming holes in the thermoplastic resin film when used as PPC original for preparing the master plate for the thermal type stencil printing machine. It has also been found that the image portion of the PPC original having such a low density carries only a very small amount of unfixed toner particles and that, when this PPC original is used to prepare the master plate for the thermal type stencil printing machine, the holes formed in the thermoplastic resin film are hardly plugged by melted toner particles.

An improved electrophotographic copying machine according to the present invention and based on the above new findings comprises image forming means for forming on a photosensitive member an electrostatic latent image corresponding to an original to be copied and developing the electrostatic latent image into a toner image, transfer means for transferring the toner image corresponding to the electrostatic latent image onto copying paper, and image density dropping means for selectively controlling the image forming means to cause a sharp drop in an image density on the copying paper with respect to a density of the original therefor.

With the above electrophotographic copying machine, the image density dropping means is operable to control the image forming means which is adjusted for a density suited for normal copying, thereby to drop the density of a copied image. Thus, the copying machine is readily switchable to a state for producing a copy suited for preparation of the master plate for the thermal type stencil printing machine.

Since the copied image portion having the low density as noted above carries only a very small amount of unfixed toner particles, the copy may be used for preparing the master plate for the thermal type stencil printing machine with little chance of the holes formed in the thermoplastic resin film being plugged by the unfixed toner particles melted through the illumination. Therefore, when the master plate thus prepared is used in the thermal stencil printing, high quality prints are produced which have a minimum of blur in the image portion.

The above and other objects and features of the present invention will become apparent from the following description to be read with reference to the accompanying drawings.

BRIEF DESCRIPTION OF THE DRAWINGS

The drawings illustrate an electrophotographic copying machine embodying the present invention, in which.

DESCRIPTION OF THE PREFERRED EMBODIMENT

An embodiment of the present invention will be described hereinafter with reference to the accompanying drawings.

Figure 1:
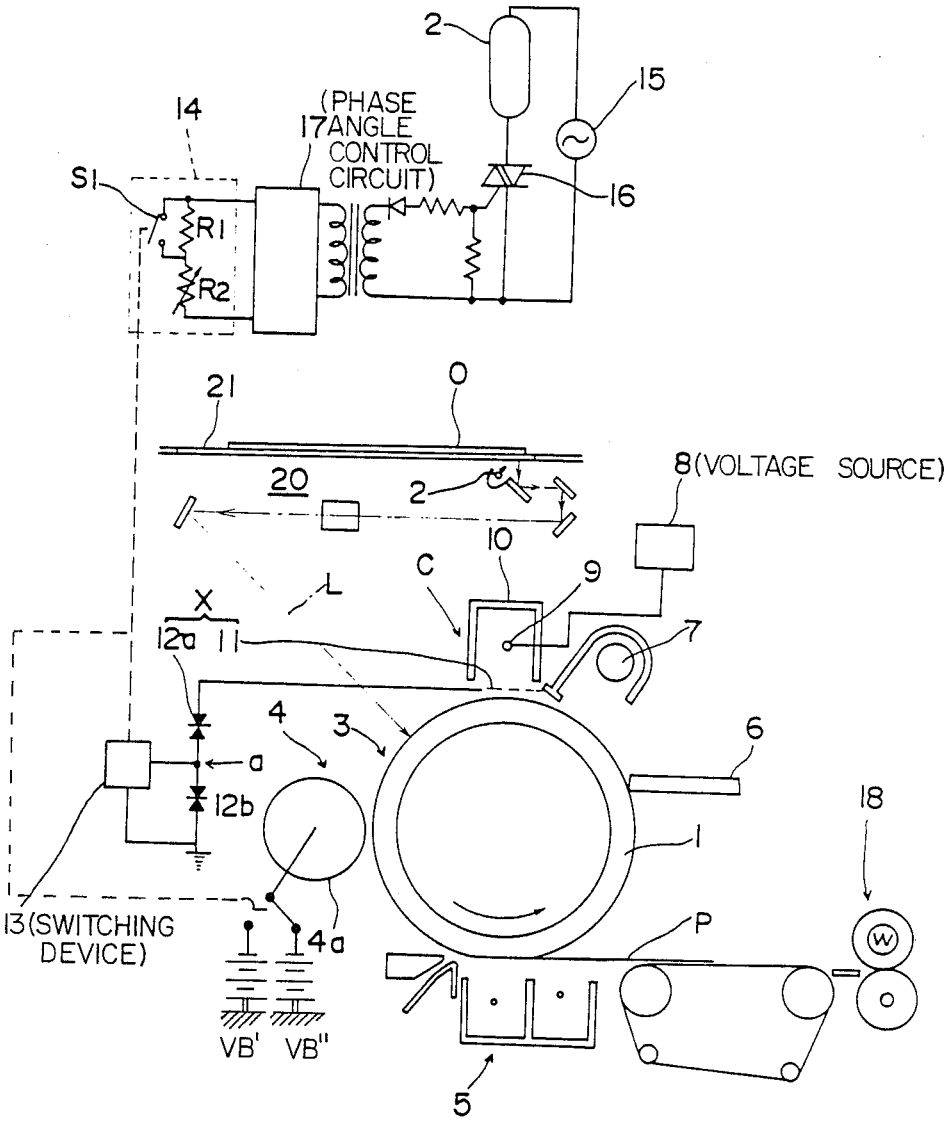
FIG. 1 is a schematic view showing a section of the machine surrounding a photoreceptor drum.

An electrophotographic copying machine embodying the present invention includes various elements surrounding a photosensitive drum 1 which is one example of photosensitive member, as schematically shown in FIG. 1. With this copying machine, an original document O placed on a glass plate 21 is illuminated by an exposure lamp 2 which is one example of light source. The image of the original illuminated is projected onto the photosensitive drum 1 by an optical system 20 to form an electrostatic latent image thereon.

The photosensitive drum 1 has an aluminum drum surface coated with a layer of organic photoconductive material such as CdS, and is driven by a drive mechanism (not shown) to rotate in the counterclockwise direction in the drawing. The photosensitive drum 1 is surrounded by a charging device C, an exposure section 3, a developing device 4 and a transfer device 5 arranged sequentially in the direction of drum rotation. The photosensitive drum 1 having its surface uniformly charged by the charging device C receives a light L at the exposure section 3 projected from the optical system 20 whereby the electrostatic latent image is formed on the drum surface.

Thereafter, the developing device 4 causes charged toner conveyed by a developing sleeve 4*a* to electrostatically and selectively adhere to the electrostatic latent image on the photosensitive drum 1 whereupon the image becomes visible. Then the toner is transferred from the drum 1 to recording paper P by the transfer device 5. The paper P separated from the drum 1 is conveyed to a heater roller type fixing device 18 where the toner is fixed to the paper P, after which the paper P is discharged from the machine.

On the other hand, toner remaining on the photosensitive drum 1 after the transfer step is removed therefrom by a cleaning device 6 and electric charge on its surface is eliminated by an eraser lamp 7. The drum 1 then rotates to a position opposed to the charging device C for a next copying sequence.

The charging device C is of the scorotron type and comprises a charging wire 9 connected to a high voltage source 8, a holder 10 covering three sides of the wire 9 and opening toward the photosensitive drum 1, and a grid electrode 11 disposed between the charging wire 9 and the surface of photosensitive drum 1.

Two varistors 12*a* and 12*b* are connected in series to the grid electrode 11 in order to maintain the charge potential of the surface of photosensitive drum 1 constant at all times, and one end of one of the varisters 12*b* is grounded. Each of the varisters 12*a* and 12*b* comprises a resister having nonlinear voltage-current characteristics, and the electric potential of the grid electrode 11 is maintained constant at all times by generating a current between the grid electrode 11 and the ground when the voltage exceeds a value determined by the combination of two varistors 12*a* and 12*b*. A bypass line is provided to ground a junction between the two varistors 12*a* and 12*b*. This bypass line includes a switching device 13 for switching the bypass line between an electrified state and an unelectrified state.

For a normal copying operation this switching device 13 places the bypass line in the unelectrified state. In this state, the grid electrode 11 of the charging device C is grounded through the two varistors 12*a* and 12*b* whereby an initial charge potential of the surface of the photosensitive drum 1 is maintained relatively high. Accordingly, in this state, a copy having a dark image portion with sharp contrast is obtained.

However, an inconvenience will occur when this copy is used as PPC original for preparing a master plate for a thermal type stencil printing machine. That is, the image portion of the copy, because of its high density, carries a large amount of toner particles not sufficiently fixed thereto by the fixing device. These toner particles are thermally fusible, and become melted when illuminated in preparing the master plate for the thermal type stencil printing machine. The melted toner particles will plug holes in a thermoplastic resin film constituting the master plate.

In order to eliminate the above inconvenience, the electrophotographic copying machine according to the present invention provides a low density copy suitable as the original for preparation of the master plate for the thermal type stencil printing machine, which is achieved by operating the switching device 13. That is to say, for providing such a low density copy the switching device 13 is operated to place the bypass line in the electrified state. In this state the grid electrode 11 of the charging device C is grounded through only one of the varistors 12*a*. As a result, the initial charge potential of the surface of photosensitive drum 1 is maintained lower than in the case of normal copying.

The copied image produced in this state is too lightly printed to be used for record but, when this copied image is used as PPC the original for preparing the master plate for the thermal type stencil copying machine, the light print of the image is effective to avoid the above-noted inconvenience since only a very small amount of unfixed toner particles remains adhering thereto. Moreover, a sufficient energy is produced for forming holes in the thermoplastic resin film when the image is illuminated in the course of preparation of the master plate. Thus, the copied image resulting as above is well suited for use as the PPC original for preparation of the master plate for the thermal type stencil printing machine.

Figure 3:
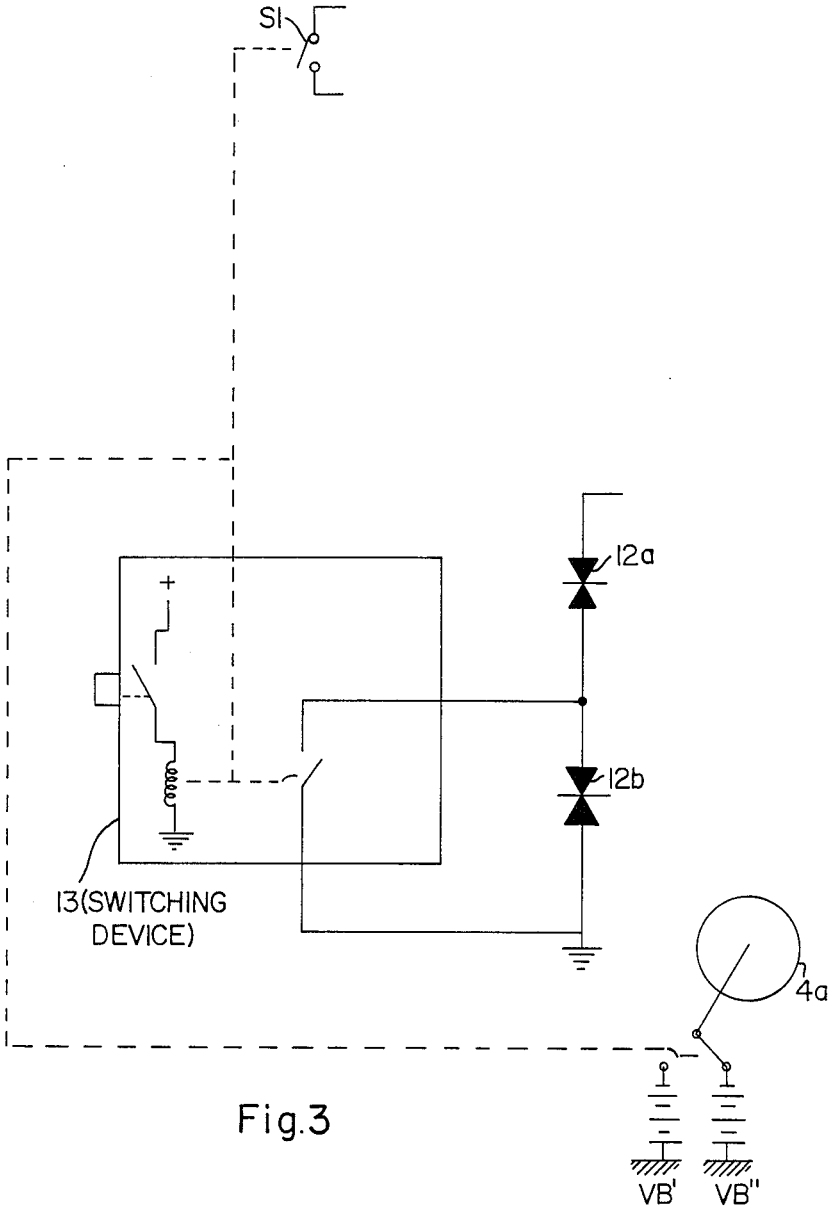
FIG. 3 is a functional illustration of a switching device in an electrophotographic copying machine of the present invention.

In other words, according to this embodiment, the grid electrode 11 constituting part of the charging device C and one of the varistors 12*a* act to control the copied image to have a lower density than the density suited for normal copying, so as to be suited for preparation of the master plate for the thermal type stencil printing machine. The switching device 13 is used to switch the density of the copied image between the low density which is realized by means of the grid electrode 11 and varistor 12*a* and the high density for normal copying which is realized by means of the grid electrode 11 and varistors 12*a* and 12*b*. Specifically, this switching device 13 comprises a relay and an ON/OFF switch for actuating the relay as illustrated in FIG. 3. The ON/OFF switch is mounted on an outer lateral face or on a control panel of the copying machine.

On the other hand, when the switching device 13 is operated to set the initial charge potential of the surface of photosensitive drum 1 to the low value, copying by an unchanged amount of exposure would result in an overexposure and a poor quality of reproduction. In order to avoid this inconvenience, an exposure control device 14 is provided to automatically set the amount of exposure by the exposure lamp 2 to a proper value in response to the operation of switching device 13 to switch the bypass line between the electrified and unelectrified states. Normally the amount of exposure by the exposure lamp 2 is varied by turning on and off a signal sent from a phase angle control circuit 17 to a triac 16 disposed between the exposure lamp 2 and an AC source 15 to vary the phase angle. In the electrophotographic copying machine according to this embodiment, the amount of exposure is varied further by effecting two-step changes to the voltage of phase angle control circuit 17 in response to the operation of the switching device 13.

More particularly, the illustrated copying machine includes two resistors R1 and R2 connected to parallel to the phase angle control circuit 17, and a switch S1 operatively connected to the switching device 13 to cause short-circuiting of one of the resistors R1. This switch S1 is opened at the time of normal copying, namely when the initial charge potential of the surface of photosensitive drum 1 is maintained high. In this state, the phase angle control circuit 17 has a high voltage and the exposure lamp 2 has a large amount of exposure. The switch S1 is closed when the initial charge potential of the surface of photosensitive drum 1 is maintained low. In this state, the phase angle control circuit 17 has a low voltage and the exposure lamp 2 has a small amount of exposure.

To be specific, the amount of exposure by the exposure lamp 2 and the initial charge potential of the surface of photosensitive drum 1 are set to the values in the following table, which are based on test results to be described later.

TABLE 1

| | normal copying | copying for preparation of master plate |
|---|---|---|
| exposure | 7.6 lux/sec | 4.3 lux/sec |
| charge potential | −600 V | −420 V |
| bias voltage | −300 V | −300 V |

While in the foregoing embodiment both the initial charge potential of the surface of photoreceptor drum 1 and the amount of exposure by the exposure lamp 2 are varied, only one of them may be varied in practicing the present invention. Furthermore, instead of varying the initial charge potential of the surface of photosensitive drum 1, the developer bias voltage applied to the developer sleeve 4*a* of the developing device 4 may be varied as illustrated, for example, in FIG. 1. In the latter case, the developer bias voltage is varied to reduce the difference in surface electric potential between the developer sleeve 4*a* and the photosensitive drum 1, whereby the same effect is produced as in the foregoing embodiment in which the initial charge potential of the surface of photosensitive drum 1 is varied.

The results of tests conducted by Applicants will be described hereinafter.

Figure 2:
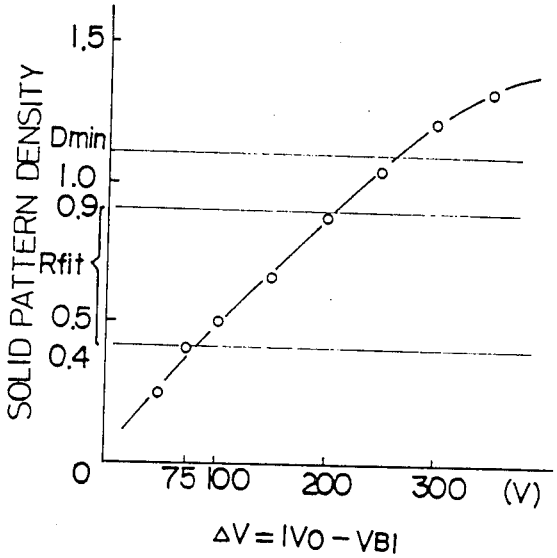
FIG. 2 is a graph showing test results.

The graph of FIG. 2 shows the density of a solid pattern copied image measured with Macbeth's reflecting densitometer RD-514, by employing as parameter the difference between the electric potential V of the surface of photosensitive drum 1 varied from −650 V to −350 V and the developing bias voltage V fixed to −300 V at developing times.

In these tests the amount of exposure was suitably adjusted to avoid overexposure. Table 2 hereunder shows results of the density measurements of the copied image and results of judgment by the eye as to presence or absence of a blur in stencil prints obtained by means of a master plate which was prepared by using the copied image as the PPC original. In the tests, "Lithograph Master" manufactured by Riso Kagaku, a Japanese company, was employed as master sheet, the plate casting machine used was "FX7200" manufactured by the same company, and the printing machine used as "AP7200" again manufactured by that company. The round mark in Table 2 represents absence of blur from the prints, the triangle mark represents partial presence of blur in the prints, and the cross mark represents presence of a very noticeable blur in the prints which faded the image.

TABLE 2

| | | | | |
|---|---|---|---|---|
| V | 50 V | 75 V | 100 V | 150 V |
| image density | 0.25 | 0.40 | 0.50 | 0.67 |
| blur | X | O | O | O |
| V | 200 V | 250 V | 300 V | 350 V |
| image density | 0.90 | 1.05 | 1.22 | 1.33 |
| blur | O | Δ | X | X |

It will be seen from the above results that the PPC original suited for preparing the master plate for the thermal type stencil printing machine was obtained when the solid pattern image density was in the range (Rfit) of 0.40 to 0.90. Though not shown in the table, when the test samples were seen as normal copies, letters were difficult to make out in the copied image of the density not exceeding 1.05 but the copied image of the density at 1.22 or above was acceptable as normal copied image. As also seen from FIG. 2, the density range suitable for preparation of the master plate is below a minimum density 1.1 (Dmin) suited for normal copying. In the electrophotographic copying machine according to the foregoing embodiment, specific values of the two varisters 12*a* and 12*b* are set so that the image density is in the range (Rfit) of 0.40 to 0.90 when the switching device 13 is operated to maintain the initial charge potential of the surface of photosensitive drum 1 to be low.

What is claimed is:

1. An electrophotographic copying machine comprising:

image forming means for forming on a photosensitive member an electrostatic latent image corresponding to an original to be copied and developing said electrostatic latent image into a toner image, transfer means for transferring said toner image corresponding to said electrostatic latent image onto copying paper, and image density dropping means for selectively controlling said image forming means to drop an image density on the copying paper to a density suitable for forming a master plate for a thermal type stencil printing machine.

2. An electrophotographic copying machine comprising:

image forming means including a photosensitive member defining a photoconductive layer on a surface thereof, a charging device for charging the surface of said photosensitive member, an exposure device having an exposure lamp for illuminating an original image and forming on said photosensitive member an electrostatic latent image corresponding to said original image, and a developing device for causing a charged toner to electrostatically and selectively adhere to said electrostatic latent image on said photosensitive member, transfer means for transferring said charged toner adhering to said photosensitive member to copying paper, and image density dropping means for selectively controlling said image forming means to drop an image density on the copying paper to a density suitable for forming a master plate for a thermal type stencil printing machine.

3. An electrophotographic copying machine as claimed in claim 2 wherein said image density dropping means is operable to control said charging device to drop an amount of electric charge applied to said photosensitive member by said charging device.

4. An electrophotographic copying machine as claimed in claim 3 wherein said charging device comprises the scorotron type including a grid electrode grounded through two varistors connected thereto in series, and said image density dropping means comprises a bypass line for short-circuiting one of said varistors.

5. An electrophotographic copying machine as claimed in claim 4 wherein said image density dropping means includes switching means mounted on said bypass line.

6. An electrophotographic copying machine as claimed in claim 5 wherein said switching means comprises a relay, and said image density dropping means further includes an ON/OFF switch for actuating said relay.

7. An electrophotographic copying machine as claimed in claim 3 wherein said image density dropping means is operable to control said exposure device to weaken the illumination by said exposure lamp.

8. An electrophotographic copying machine as claimed in claim 7 wherein said image density dropping means is operable to control said developing device to shift a developing bias voltage.

9. An electrophotographic copying machine as claimed in claim 2 wherein said image density dropping means is operable to control said exposure device to shift the illumination by said exposure lamp thereby to drop an amount of electric charge for the photosensitive member.

10. An electrophotographic copying machine as claimed in claim 9 wherein said image density dropping means is operable to control said developing device to shift a developing bias voltage.

11. An electrophotographic copying machine as claimed in claim 9 wherein said exposure device includes a triac disposed between said exposure lamp and an AC source, and a phase angle control circuit for controlling said triac, and said image density dropping means comprises a circuit for shifting a voltage of said phase angle control circuit.

12. An electrophotographic copying machine as claimed in claim 11 wherein said image density dropping means includes switching means mounted on said voltage shifting circuit.

13. An electrophotographic copying machine as claimed in claim 2 wherein said image density dropping means is operable to control said developing device to shift a developing bias voltage.

14. An electrophotographic copying machine comprising:

image forming means for forming an electrostatic latent image on a photosensitive member and developing said electrostatic latent image into a toner image, and image density dropping means for controlling said image forming means to drop an image density on copying paper to a density suitable for forming a master plate for a thermal type stencil printing machine, wherein said image forming means is adjusted to provide a density of a copied image of at least 1.1, and said image density dropping means is selectively operable to control said image forming means to drop the density of the copied image to be in a range of from about 0.4 to about 0.9.

15. An electrophotographic copying machine comprising:

image forming means including a photosensitive member defining a photoconductive layer on a surface thereof, a charging device for charging the surface of said photosensitive member, an exposure device having an exposure lamp for illuminating an original image and forming on said photosensitive member an electrostatic latent image corresponding to said original image, and a developing device for causing charged toner to electrostatically and selectively adhere to said electrostatic latent image on said photosensitive member, transfer means for transferring said charged toner adhering to said photosensitive member to copying paper, and image density dropping means for controlling said image forming means to drop an image density on the copying paper to a density suitable for forming a master plate for a thermal type stencil printing machine, wherein said image forming means is adjusted to provide a density of a copied image of at least 1.1, and said image density dropping means is selectively operable to control said image forming means to drop the density of the copied image to be in a range of from about 0.4 to about 0.9.

16. An electrophotographic copying machine as claimed in claim 15 wherein said image density dropping means is operable to control said charging device to drop an amount of electric charge applied to said photosensitive member by said charging device.

17. An electrophotographic copying machine as claimed in claim 16 wherein said charging device comprises the scorotron type including a grid electrode grounded through two varistors connected thereto in series, and said image density dropping means comprises a bypass line for short-circuiting one of said varistors, and wherein said image density dropping means includes a relay mounted on said bypass line and an ON/OFF switch for actuating said relay.

18. An electrophotographic copying machine as claimed in claim 16 wherein said image density dropping means is operable to control said exposure device to weaken the illumination by said exposure lamp.

19. An electrophotographic copying machine as claimed in claim 18 wherein said image density dropping means is operable to control said developing device to shift a developing bias voltage.

20. An electrophotographic copying machine as claimed in claim 15 wherein said image density dropping means is operable to control said exposure device to shift the illumination by said exposure lamp thereby to drop an amount of electric charge for the photosensitive member.

21. An electrophotographic copying machine as claimed in claim 20 wherein said exposure device includes a triac disposed between said exposure lamp and an AC source, and a phase angle control circuit for controlling said triac, and said image density dropping means comprises a circuit for shifting a voltage of said phase angle control circuit.

22. An electrophotographic copying machine as claimed in claim 15 wherein said image density dropping means is operable to control said developing device to shift a developing bias voltage.

* * * * *